United States Patent [19]

Kasper et al.

[11] 4,076,857

[45] Feb. 28, 1978

[54] PROCESS FOR DEVELOPING ELECTROGRAPHIC IMAGES BY CAUSING ELECTRICAL BREAKDOWN IN THE DEVELOPER

[75] Inventors: George Philip Kasper; John Walter May, both of Rochester, N.Y.

[73] Assignee: Eastman Kodak Company, Rochester, N.Y.

[21] Appl. No.: 700,248

[22] Filed: Jun. 28, 1976

[51] Int. Cl.[2] ..... G03G 13/06; G03G 13/08; G03G 13/09

[52] U.S. Cl. ..... 427/18; 96/1 SD; 427/14; 427/17

[58] Field of Search ..... 427/14, 18, 19, 20, 427/21, 17; 96/1 LY, 1 SD; 118/647-651; 355/3 DD

[56] References Cited

U.S. PATENT DOCUMENTS

| | | | |
|---|---|---|---|
| 3,219,014 | 11/1965 | Mott et al. | 427/18 X |
| 3,424,131 | 1/1969 | Aser et al. | 427/20 X |
| 3,428,025 | 2/1969 | Sullivan | 427/14 X |
| 3,674,532 | 7/1972 | Morse | 427/18 X |
| 3,783,826 | 1/1974 | Urbanek et al. | 96/1 LY |
| 3,893,408 | 7/1975 | Lamel | 118/7 |
| 3,932,034 | 1/1976 | Takahashi | 355/3 DD |

OTHER PUBLICATIONS

Kutsuwada, Norborn and Ando, Yujiro; "Studies on Transfer of Electrophotographic Powder Images," Denshi Shashin [Electrophotography] 10, No. 1, 14-17, (1971).

Harpavat, G.; "Electrostatic Field Stripping Model of Magnetic Brush Development," Conference Record IAS 1975; pp. 128-134.

Schein, L. B., "The Physics of Magnetic Brush Development" Conference Record IAS 1975; pp. 140-144.

*Primary Examiner*—Ronald H. Smith
*Assistant Examiner*—Stuart D. Frenkel
*Attorney, Agent, or Firm*—Ogden H. Webster

[57] ABSTRACT

Development of electrostatic charge patterns (e.g., electrostatic latent images) carried on a support is accomplished in an electrographic process in which during development, an electrical field which is greater than the electrical breakdown value of the developer (i.e., greater than the maximum electrical field that the developer can support without undergoing electrical breakdown) is established across the developer in the development area. The process enables development of high quality, large solid-area images at high processing rates.

13 Claims, 6 Drawing Figures

PROCESS FOR DEVELOPING ELECTROGRAPHIC IMAGES BY CAUSING ELECTRICAL BREAKDOWN IN THE DEVELOPER

FIELD OF THE INVENTION

This invention relates to electrography and particularly to methods for developing electrostatic charge patterns.

DESCRIPTION OF THE PRIOR ART

In the electrographic reproduction of images, the development of large solid-area images at high machine development rates, has not been completely satisfactory. Many interesting techniques have been proposed to improve solid-area development. Many development devices such as multi-roller, magnetic brush developing stations have been devised. Various techniques have met with differing degrees of success. Some approaches have been very successful but very limited in application. No solution to the high rate, solid-area development problem has been found that is universally compatible with the more practical development systems. Dessauer and Clark discuss some of the more important techniques for improving solid-area development in "Xerography and Related Processes", Focal Press Limited (1965) on pages 276–287.

Generally, electrographic processes capable of large solid-area development make use of a development electrode or of screening techniques. A development electrode is a conducting surface placed in close proximity to the electrostatic image bearing surface to be developed in order to establish external fields that accurately represent the charge density of the electrostatic charge pattern. The screening techniques for developing large solid area images generally involve transforming the large solid area into an array of charged dots or lines which can then be developed by edge fields. Electrostatic charge patterns consisting of such arrays can be created by initially charging the xerographic surface in a screen pattern, by masking the original image during projection, or by selectively discharging the xerographic surface either before, during, or after image exposure.

Considerable complexity surrounds many of the various approaches to the goal of solid-area development. Further, the prior art techniques have generally suffered from poor quality, poor development latitude, or low density in the developed large solid-area, especially when operating electrographic processes at high processing rates. Often the low density results from slow development rates or weak development fields. Thus, there is a continuing need for an electrographic development process which can provide good quality, increased development latitude, and high density for large solid-area images at high processing rates.

SUMMARY OF THE INVENTION

The present invention provides a method for developing electrostatic images which yields high-quality, rapidly-produced, solid-area reproductions. Accordingly, a support bearing an electrostatic charge pattern (e.g., an electrostatic latent image) is contacted with a developer having a predetermined electrical breakdown value. As used herein with respect to a developer mixture, the term electrical breakdown value denotes the value of the maximum electrical field that such developer can support without undergoing electrical breakdown under the actual conditions of development. The contact is maintained for a time period sufficient to deposit marking particles from the developer composition onto the electrostatic charge pattern. During the development process, development of the electrostatic charge pattern is accomplished by controlling the development process such that an electrical field which is greater than the electrical breakdown value of the developer (i.e., greater than the maximum electrical field that the developer can support without undergoing electrical breakdown) is established across the developer in the development area, thereby causing the developer to undergo electrical breakdown in the development area in the development of the electrostatic charge pattern. The development parameters which can be controlled to effect proper development in accordance with the process of the invention include, for example, the amount of charge on the support, the distance between the support and a biasing electrode as described hereafter (which is the distance across which the electrical field is established to exceed the predetermined electrical breakdown value of the developer), the bias on the biasing electrode, and the like.

When using the development process of the invention, the potential at the surface of the developer (i.e., that which is adjacent to electrostatic image bearing member) in the development area approaches that of the biasing electrode, e.g., the magnetic brush roller surface. As a result, the difference in potential between the surface of the developer and the electrostatic image bearing surface approaches its maximum possible value and development will approach taking place at the maximum rate.

DETAILED DESCRIPTION OF THE INVENTION

Figure 1:
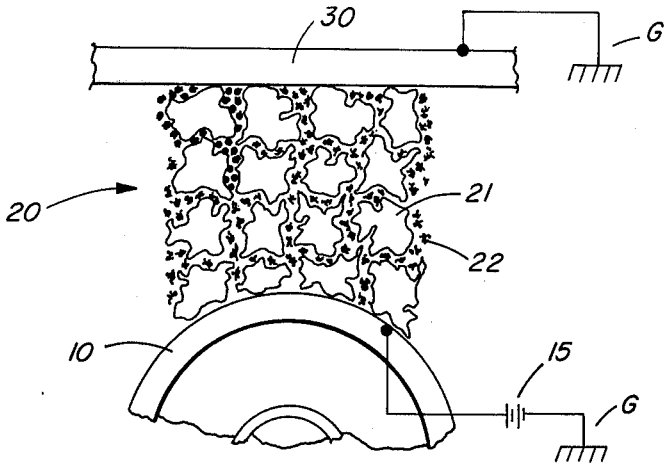
FIG. 1 is a sketch illustrating the relation between an electrostatic image bearing surface, developer, and a magnetic roller surface for an embodiment of the development process using a magnetic brush.

In accordance with the present invention a method for developing electrostatic charge patterns is provided. While the method for developing electrostatic charge patterns described herein can be used in any development process that uses a development electrode in the classical sense as described by Schaffert, "Electrophotography", 2nd Edition, page 35, the method of this invention is particularly useful in processes using a magnetic brush development apparatus. The biasing electrode described herein corresponds to a development electrode in the classical sense as described by Schaffert. Therefore the invention will be described with any references to a specific development process being made to a magnetic brush development process such as illustrated in FIG. 1.

In a magnetic brush development process, a roller 10, which generally is constructed with an electrically conducting non-magnetic outer surface surrounding at least one stationary magnet, carries a developer composition 20 into contact with a support 30 bearing an electrostatic latent image. The area of contact between the support 30 and the developer 20 is called herein the development area. The developer composition 20 includes a mixture of ferromagnetic carrier particles 21 and toner particles 22. The toner particles 22 are triboelectrically charged by the carrier particles 21 and are attracted to the electrostatic latent image carried on the support 30 to produce a visible image. The support 30 is connected to an electrical ground G. The support 30 can be a photoconductive element or an insulative film capable of carrying an imagewise charge pattern. Development of solid area images can be enhanced by connecting the magnetic roller 10 to an electrical ground G. Often a bias voltage 15 is placed on the roller 10 to reduce unwanted background in the developed image. The biased roller is referred to herein as the biasing electrode.

Figure 2:
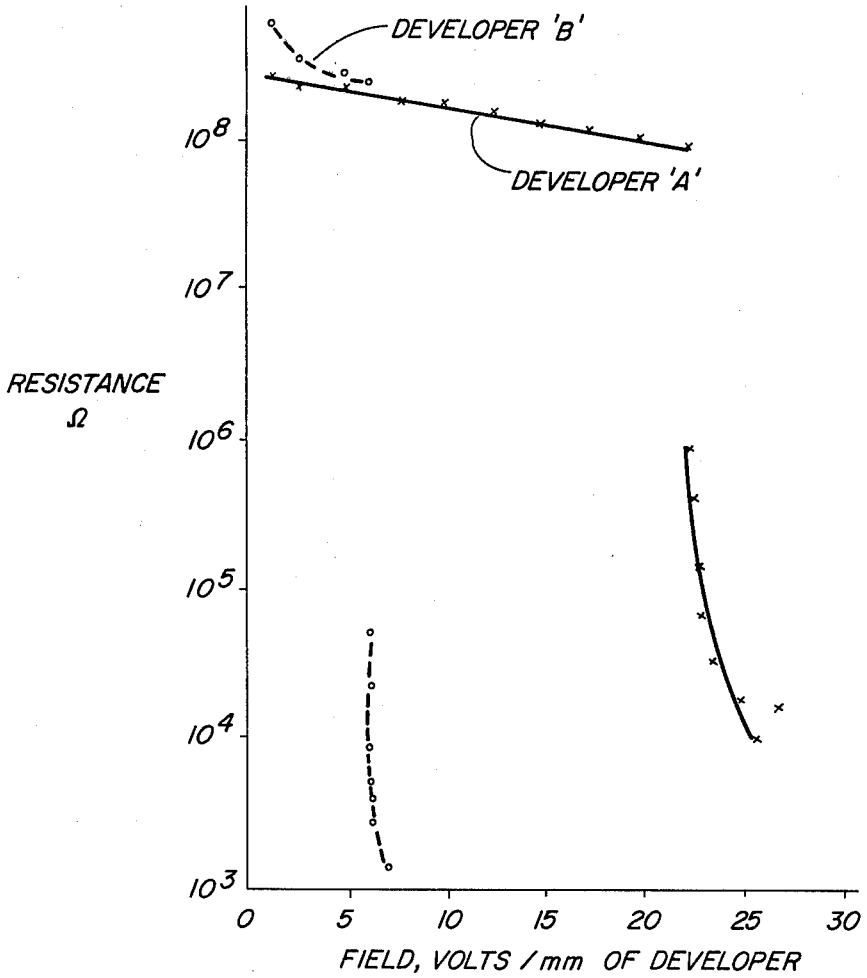
FIG. 2 is a graph illustrating the typical nonohmic behaviour of certain developer compositions.

We have discovered that, under controlled conditions, certain developer materials will undergo a phenomenon called herein "electrical breakdown". This breakdown phenomenon exhibited by certain developer materials manifests itself when measuring the resistance of the developer material as a function of the electrical field across the developer. The resistance is conveniently measured by placing a metal electrode at the plane of the support 30 above an operating magnetic brush, applying a known potential to the electrode, and measuring the current passing through the magnetic brush. Resistance is calculated by dividing the current by the voltage. As illustrated in FIG. 2, at a certain level of the applied field, called the electrical breakdown value, for a small increase in field there is a large drop in the resistance of the developer material. This breakdown value is the value defined by the discontinuity in the resistance versus field curve seen in FIG. 2. The field strength is given in volts per unit thickness of the developer across which the potential is placed. The breakdown value should be measured in the given process configuration under dynamic operating conditions (i.e., actual magnet configuration, actual toner concentration, RH, support-brush spacing, support pressure on the developer, brush rpm, etc.).

We have now found that developing electrostatic charge patterns under conditions which induce developer breakdown result in improved solid area development and faster development rates. It is generally believed that the development rate is proportional to the electric field strength between the electrostatic image bearing surface and the developer surface and that this electric field is maximized when developing under conditions which induce developer breakdown. It is now believed that when breakdown operation is achieved, the development rate at constant electric field is limited only by toner replenishment.

The electrostatic charge pattern to be developed can be provided on a support by a variety of methods well known to those having average skill in the art. Such methods include, for example, charging and exposing a photoconductive element, depositing a charge pattern on an insulating surface, and other known methods.

Development by the developer breakdown mode can be influenced by the following factors: the composition of the carrier particles; the concentration of toner particles in the developer; the strength of the electric field between the surface bearing the electrostatic charge pattern and the biasing electrode; and the thickness of the developer (i.e., the distance between the surface bearing the electrostatic charge pattern and the biasing electrode). Development in accordance with the teachings of this invention is accomplished by selecting one or more of the aforementioned factors such that the electric field which forms across the developer during development is greater than the breakdown value of the developer material under the conditions of development.

Developer compositions useful in the practice of the present invention are those which exhibit the breakdown phenomenon as illustrated by FIG. 2. In order to prevent discharging of the latent image, preferred developer compositions are those which exhibit relatively high resistivity prior to breakdown, i.e., when subjected to a low strength electric field. A low field resistivity of at least $10^5$ ohm-cm is preferred.

Developer compositions comprise marking particles as one component and may contain other components. Generally, most commercial developer compositions are two component developers having carrier particles and toner particles which are the marking particles. The bulk resistance of such carrier particles when measured under low fields across 4 mm of thickness can vary from 10–100 ohms up to greater than $10^{14}$ ohms. Toner compositions used in developer compositions useful herein are generally relatively non-conductive, having a resistivity of about $10^{14}$ ohms-cm.

By the terms "low field resistivity" and "measured under low fields" as used herein, we mean resistance measurements made using a General Radio D.C. Electrometer (Type 1230-A, 6–9 volts) or comparable equipment in accordance with the following procedure and other measurements which are the equivalent.

This test is conducted each time using a 15 gram quantity of developer material. A cylindrically-shaped bar magnet having a circular end of about 6.25 square centimeters in area is used to attract the carrier and hold it in the form of a brush. After formation of the brush, the bar magnet is positioned with the brush-carrying end approximately parallel to and about 0.5 cm from a burnished copper plate. The resistance of the particles in the magnetic brush is then measured between the magnet and the copper plate.

Developer compositions that are particularly useful for the practice of the present invention are those developer compositions comprising carrier particles which have a ferromagnetic core bearing a thin layer of an electrically conducting metal resistant to aerial oxidation and overcoated with a resinous material. Typical of such materials are those carrier particles described in U.S. Pat. No. 3,736,257 issued on May 29, 1973 to Howard A. Miller which are then usually overcoated with a non-continuous layer of a resinous material.

Suitable materials useful for the thin electrically conducting layer coated on the carrier core include those metals in Groups VIa, VIII, Ib and IIb of the Periodic Table (Cotton and Wilkinson, *Advanced Inorganic Chemistry,* 1962, page 30). Particularly useful metals are cadmium, chromium, copper, gold, nickel, silver zinc and the platinum group elements which include ruthenium, rhodium, palladium, osmium, iridium and platinum as well as mixtures or alloys of any of these.

Numerous resins have been used in the art for overcoating carrier particles. Examples of such resins include those described in the working examples of U.S. Pat. No. 3,745,617, issued Mar. 5, 1974 to John M. McCabe and U.S. Pat. No. 3,795,618, issued Mar. 5, 1974 to George P. Kasper. Any of these well known resins can be used to make carrier particles useful herein. The selection of the particular resin to be used will depend upon its triboelectric relationship with the toner composition being used. Especially useful resins include poly(vinylidene fluoride) and poly(vinylidene fluoride-co-tetrafluoroethylene).

Developer compositions can be prepared by mixing carriers with a suitable electroscopic toner material. In general, useful developers are comprised of from about 90 to about 99% by weight of carrier and from about 10 to about 1% by weight of toner. The toner used with the carrier particles can be selected from a wide variety of materials to give desired physical properties to the developed image and the proper triboelectric relationship to match the carrier particles used. Generally, any of the toner powders known in the art are suitable for mixing with the carrier particles of this invention to form a developer composition. When the toner powder selected is utilized with ferromagnetic carrier particles in a magnetic-brush development arrangement, the toner clings to the carrier by triboelectric attraction. The carrier particles acquire a charge of one polarity and the toner acquires a charge of the opposite polarity. Thus, if the carrier is mixed with a resin toner which is higher in the triboelectric series, the toner normally acquires a positive charge and the carrier a negative charge.

Toner powders suitable for use in this invention are typically prepared by finely grinding a resinous material and mixing it with a coloring material such as a pigment or a dye. The mixture is then heated and roll milled for a sufficient length of time so that the coloring material is dispersed in the resin. The mass is cooled, broken into small chunks and finely ground again. After this procedure the toner powder particles usually range in diameter of from about 0.5 to about 25$\mu$, with an average size of about 2 to about 15$\mu$.

The resin material used in preparing the toner can be selected from a wide variety of materials, including natural resins, modified natural resins and synthetic resins. Exemplary of useful natural resins are balsam resins, colophony and shellac. Exemplary of suitable modified natural resins are colophony-modified phenol resins and other resins listed below with a large proportion of colophony. Suitable synthetic resins are all synthetic resins known to be useful for toner purposes, for example, polymers, such as vinyl polymers including polyvinyl chloride, polyvinylidene chloride, polyvinyl acetate, polyvinyl acetals, polyvinyl ether and polyacrylic and polymethacrylic esters; polystyrene and substituted polystyrenes or polycondensates, e.g., polyesters, such as phthalate resin, terephthalic and isophthalic polyesters, maleinate resin and colophony-mixed esters of higher alcohols phenol-formaldehyde resins, including colophony-modified phenol-formaldehyde condensates, aldehyde resins, ketone resins, polyamides and polyadducts, e.g., polyurethanes. Moreover, polyolefins such as various polyethylenes, polypropylenes, polyisobutylenes and chlorinated rubber are suitable. Additional toner materials which are useful are disclosed in the following U.S. Pat. Nos.: 2,917,460; Re. 25,136; 2,788,288; 2,638,416; 2,618,552 and 2,659,670.

Color material can be incorporated into toners to render electrostatic images toned therewith more distinct or visible. The coloring material additives useful in suitable toners are preferably dyestuffs and colored pigments. These materials serve to color the toner and thus render it more visible. In addition, they sometimes affect, in known manner, the polarity of the toner. In principle, virtually all of the compounds mentioned in the Color Index, Vols. I and II, second edition, 1956, can be used as colorants. Included among the vast number of suitable colorants would be such materials as Nigrosin Spirit soluble (C.I. 50415), Hansa Yellow G (C.I. 11680), Chromogen Black ETOO (C.I. 14645), Rhodamine B (C.I. 45170), Solvent Black 3 (C.I. 26150), Fuchsine N (C.I. 42510), C.I. Basic Blue 9 (C.I. 52015), etc.

Figure 3:
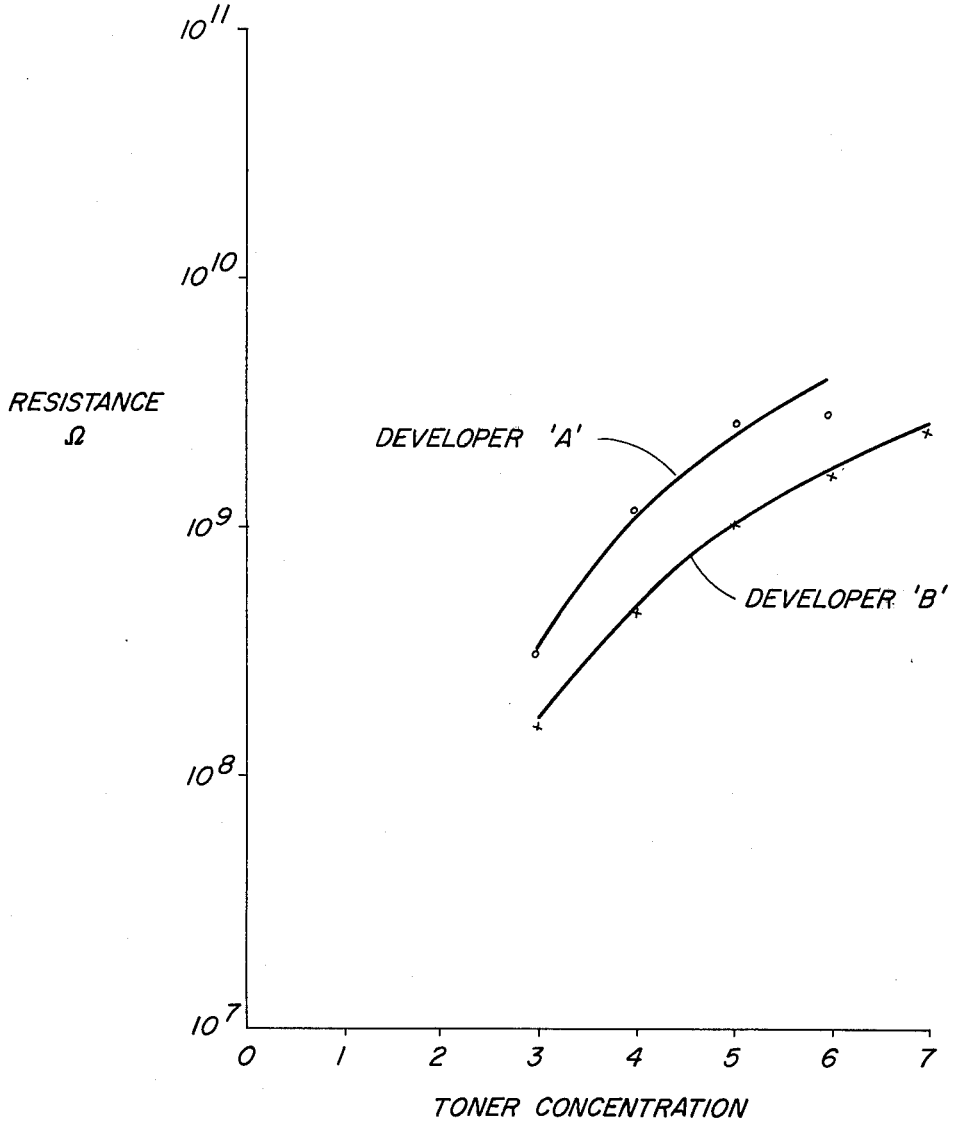
FIG. 3 is a graph illustrating developer resistance versus toner concentration at 50% relative humidity for certain developer compositions using a 7 volt potential across 4 millimeters of the developer.
Figure 4:
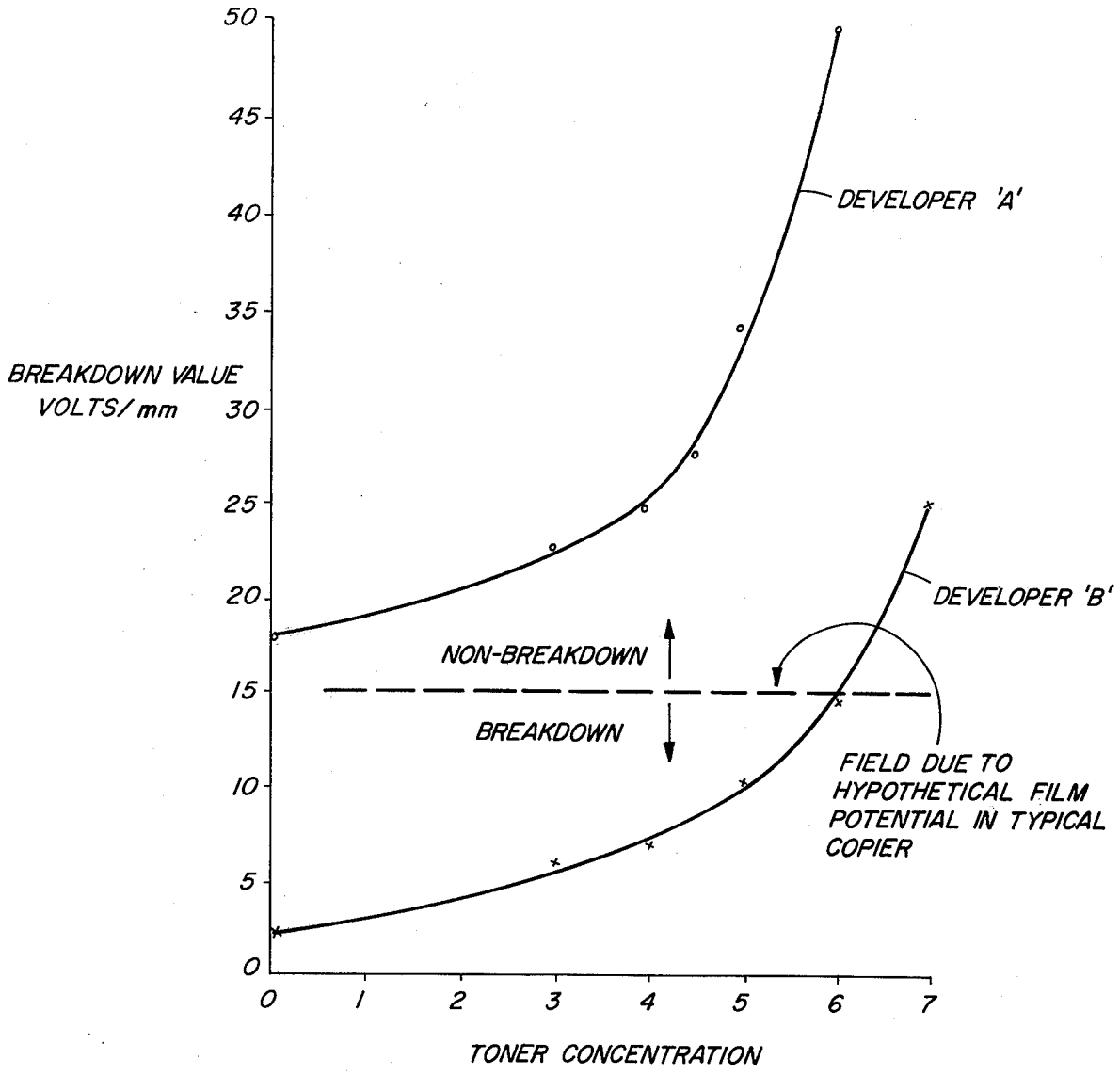
FIG. 4 is a graph illustrating the relationship between developer breakdown field and toner concentration for certain developers.

The quantity of toner in the developer composition affects both the resistance of the developer and the breakdown value. FIG. 3 illustrates the relationship between developer resistance at low field and toner concentration for particular developer compositions. In FIG. 4 is illustrated the relationship between breakdown value and toner concentration for the same developer compositions. It can also be noted by observing FIG. 4 that in a particular development system having a field due to a hypothetical film or photoconductor potential that Developer B will function in the breakdown mode during the development process, at least until the toner concentration is high enough to raise the breakdown value above the value associated with the potential on the film. Developer A will not function in the breakdown mode in this particular system because its breakdown value, regardless of toner concentration, is always higher than the electric field between the film and brush bias electrode.

Figure 5:
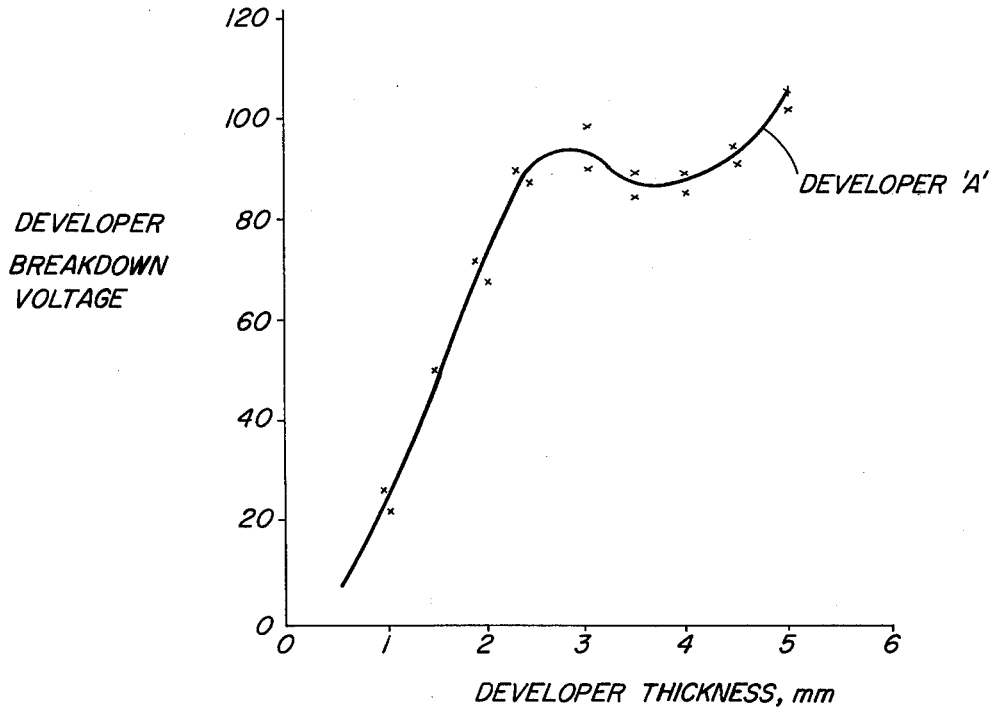
FIG. 5 is a graph illustrating the relationship between developer breakdown voltage and developer thickness for a particular developer.

The breakdown value is also dependent on developer thickness as illustrated by FIG. 5 for a particular developer composition. In the development process, the developer thickness is changed by varying the distance or gap between the surface bearing the electrostatic charge pattern and the biasing electrode. See FIG. 1, for example, where the developer thickness is the distance between the support 30 and the surface of the roller 10.

According to the present invention, a development system is provided such that, in the development of an electrostatic charge pattern, the developer undergoes electrical breakdown. When development occurs via the breakdown mode, the developer acts as though it has a very low resistance and it is postulated that the developer thus acts as though it is a perfect development electrode (i.e., an electrode which is established at the surfaces of those carrier particles nearest the electrostatic charge pattern and separated from the electrostatic charge pattern only by toner particles thus creating the strongest theoretical imaging field for development). Very large development fields are rapidly established in the development area, and high development rates follow which allow high throughput rates and high densities.

The required field strength, in order to develop in the breakdown mode, can be obtained by selecting the development system parameters discussed hereinabove such as, for example, initial photoconductor charge or charge on the support 30, developer thickness or spacing between the image-bearing support and the biasing electrode, bias voltage on the biasing electrode, photoconductor thickness to alter surface potential per unit charge, etc. It is readily apparent, however, that physical limitations may prevent the designing of a development system which will enable field strengths to exceed the breakdown value for some particular developer compositions. Therefore, preferred developer compositions are those which have relatively low breakdown values. Less than 25 volts/mm is typical.

In another embodiment of the present invention, to facilitate breakdown, the development process is accomplished while superimposing an A.C. potential across the developer. The frequency of the A.C. signal must be high enough so that ripple effects in the resultant print are not present. Typically, a frequency of 60 Hz is sufficient. However, the minimum frequency is best determined experimentally, since the developed image is influenced by many variables. The wave form of the A.C. signal can also be varied. Thus, sine waves, square waves, sawtooth waves or combinations thereof could be used. The magnitude of the peak-to-peak A.C. voltage can also be varied according to the effect desired.

The invention is further illustrated and the advantages thereof will be readily appreciated by those skilled in the art upon observation of the examples which follow.

EXAMPLE 1

Carrier particles for Developer A compositions were made from oxidized Hoegannes EH sponge iron (80/150, i.e., having a particle size greater than 80 mesh and less than 150 mesh) overcoated with 0.16 weight percent Kynar 7201 (a copolymer of vinylidene fluoride-tetrafluoroethylene from Pennwalt Corp.). The toner for Developer A compositions was a resin bond toner composition containing about 6 percent by weight carbon black. After mill blending and grinding, the resultant toner has a particle size distribution of from about 1 to about 20 micrometers.

A developer composition was made up having the above carrier particles and 3 percent by weight of the above toner composition. The resistance of 4 mm of developer thickness was measured as a function of the electric field applied across the developer. The results are plotted in FIG. 2. Note the discontinuity in the curve at about 22 volts/mm indicating that developer breakdown is occurring. The breakdown value for a developer is the field strength at which this discontinuity occurs.

A number of developers were made up using the same carrier and toner materials described above, except the concentration of the toner was varied. In FIG. 3, the curve labelled Developer A shows the relationship between resistance and toner concentration for these developers when a 7 volt field is applied across 4 mm of the developer.

EXAMPLE 2

Carrier particles for Developer B compositions were made from Hoegannes EH sponge iron (80/150 as in Example 1) plated with one percent by weight nickel according to the teachings of U.S. Pat. No. 3,736,257 issued to Howard A. Miller on May 29, 1973. The nickel layer was overcoated with 0.5 weight percent of a mixture of 100 parts by weight Kynar 7201 and 9 parts Vulcan XC-72 carbon black. The toner for Developer B compositions was a resin bond toner composition containing about 5 percent by weight carbon black and having a particle size distribution of from about 1 to about 20 micrometers.

A developer composition was made up having the carrier particles described above and 4 percent by weight of the toner of Example 1. The resistance as a function of the potential applied across the developer was measured as in Example 1 and the results are shown in FIG. 2. Note the discontinuity at about 6 volts/mm indicating that developer breakdown for Developer B will occur at a much lower electric field than Developer A.

A number of "B" developers were made up having various toner concentrations. The resistance of these various developers was measured as in Example 1 and the results are shown in FIG. 3.

EXAMPLE 3

"A" developers and "B" developers were made up having various toner concentrations. The breakdown value for each developer was determined as in Examples 1 and 2 and the breakdown value was plotted as a function of toner concentration. See FIG. 4. Note that, if a hypothetical field due to the difference in film potential (i.e., potential on the electrostatic image bearing support) and magnetic brush bias potential of 15 volts/mm is selected, Developer A will never function in a breakdown mode during development whereas Development B will function in the breakdown mode until its toner concentration is greater than about 6 percent.

EXAMPLE 4

The breakdown value for Developer A was determined as a function of developer thickness. The results are shown in FIG. 5. As might be expected the voltage associated with the electrical breakdown of a developer is dependent on developer thickness. Thus, for the hypothetical field of 15 volts/mm in Example 4, if the thickness of the developer used for FIG. 5 were reduced to about 1.8 mm or less and the film and bias voltages held constant, the breakdown value of the developer would be exceeded and the developer would function in the breakdown mode.

Increasing the bias level on the development electrode to increase the field across the developer or any other equivalent technique which effectively increases the field per unit of thickness of the developer above the breakdown value will enable the developer to operate in the breakdown mode.

EXAMPLE 5

Electrographic prints were made using a magnetic brush development system having a 6.2 mm spacing between the brush and the photoconductor and −150 volt D.C. bias level on the brush. The potential on the photoconductor film surface was −450 volt. Developer B was used for development and the transmission density of the resultant images were measured.

The above process was repeated with everything the same except that a 400 Hz, 75 volt rms A.C. sine wave signal was supplied in series with the −150 volt D.C.

bias applied to the magnetic brush. Transmission densities of the resultant images when using the A.C. sine wave were significantly higher for all densities. Background density in the prints was not increased when using the A.C. sine wave input.

EXAMPLE 6

A magnetic brush was set up having an electrode placed in the position where the photoconductor or other image bearing surface would normally be. A charged capacitor was discharged via the electrode through various developer compositions. The capacitor magnitude was selected to deliver an amount of charge similar to that of a charged photoconductor of equivalent surface area of the electrode. The voltage on the electrode and the current through the brush was monitored as a function of time with an oscilloscope. From the current and voltage versus time curves, the decay time constant for the developer was derived.

When the field across the developer was below the breakdown field of that developer, the time constant was in the millisecond range. When the field across the developer was greater than the breakdown value the time constant was in the nanosecond range due to the apparent low resistivity of the developer in the breakdown mode. The magnitude of field at which breakdown occurs can easily be observed with this system.

EXAMPLE 7

This example illustrates the benefits of operating in the breakdown mode at higher photoconductor film velocities in a copier apparatus. The developer compositions were as follows:

Developer X — The carrier was made from Hoeganaes EH sponge iron 80/150 overcoated as received with 0.16 weight percent Kynar 7201. The toner was the same as used in Example 1. A developer composition was mixed having 5% by weight toner. The resulting developer had a breakdown value of 22 volts/mm.

Developer Y — The carrier was made from Hoeganaes EH sponge iron 80/150 plated with nickel and having a highly oxidized surface. The oxidized nickel surface was then coated with 0.15 weight percent Kynar 7201. The toner was the same as used in Example 1. A developer composition was mixed having 5% by weight toner. The resulting developer had a breakdown value of 183 volts/mm.

The above developers were used to develop electrostatic images in a magnetic brush development system. The parameters of the system where the same for each developer, that is:

1. A two roller magnetic brush (7.6 cm diameter rollers) operating at 170 rpm was used for development;
2. A photoconductor film was charged to a potential of −500 volts prior to exposure;
3. During development the magnetic brush was biased at a potential of −175 volts; and
4. Both rollers were spaced 30.5 mm from the photoconductor film during development.

Figure 6:
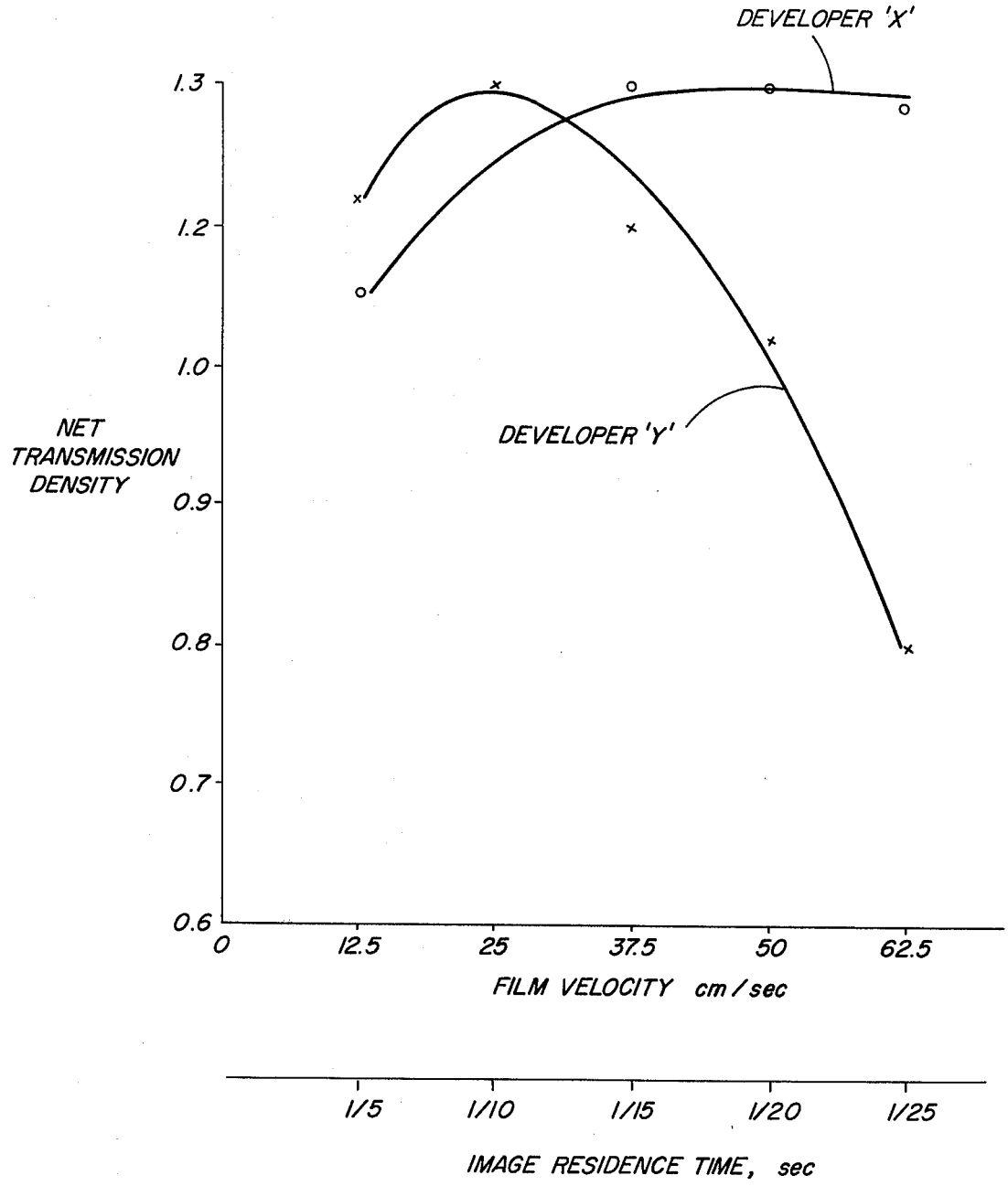
FIG. 6 is a graph showing the net transmission density of a developed image as a function of the velocity of the film bearing the latent image or as a function of image residence time for a developer operating in the breakdown mode—Developer X; and for a developer not operating in the breakdown mode—Developer Y.

These conditions were sufficient to establish an electric field having a magnitude greater than 22 volts/mm but significantly less than 183 volts/mm across the developer during development. The density of a solid-area image is plotted against the velocity of the film for each developer. See FIG. 6. The benefits of operating under conditions which promote breakdown is readily apparent from an inspection of FIG. 6.

The invention has been described in detail with particular reference to certain preferred embodiments thereof, but it will be understood that variations and modifications can be effected within the spirit and scope of the invention.

What is claimed is:

1. An electrographic process wherein a support bearing an electrostatic charge pattern is developed using an electrographic developer composition comprising marking particles and having a predetermined electrical breakdown value, said process comprising:

contacting the electrostatic charge pattern with the developer composition in a development area for a time period sufficient to deposit marking particles onto the electrostatic charge pattern thereby developing the image;

controlling the development process in the development area to establish across the developer composition in the development area during such time period an electrical field greater than the electrical breakdown value of the developer, thereby causing the developer composition to undergo electrical breakdown in the development of the electrostatic charge pattern.

2. An electrographic process wherein a support bearing an electrostatic charge pattern is developed using an electrographic developer composition comprising a triboelectric mixture of carrier particles and toner particles and having a predetermined electrical breakdown value, said process comprising:

contacting the electrostatic charge pattern with the developer composition in a development area for a time period sufficient to deposit toner particles from the developer composition onto said electrostatic charge pattern thereby developing an image; and establishing across the developer composition in the development area during such time period an electrical field greater than the electrical breakdown value of the developer, thereby causing the developer composition to undergo electrical breakdown in the development of the electrostatic charge pattern.

3. An electrographic process wherein a support bearing an electrostatic charge pattern is developed, said process comprising:

providing a dry, electrographic developer composition comprising a triboelectric mixture of carrier particles and toner particles and having a low field resistivity of at least $10^5$ ohm-cm and a predetermined electrical breakdown value;

contacting the electrostatic charge pattern with the developer composition in a development area for a time period sufficient to deposit toner particles onto the electrostatic charge pattern thereby developing an image; and establishing across the developer composition in the development area during such time period an electrical field greater than the electrical breakdown value of the developer, thereby causing the developer composition to undergo electrical breakdown in the development of the electrostatic charge pattern.

4. An electrographic process wherein a support bearing an electrostatic charge pattern is developed, said process comprising:

providing a dry, electrographic developer composition comprising a triboelectric mixture of carrier particles and toner particles and having a predetermined electrical breakdown value which is less than 25 volts/mm;

contacting the electrostatic charge pattern with the developer composition in a development area for a time period sufficient to deposit toner particles from the developer composition onto said electrostatic charge pattern thereby developing an image; and establishing across the developer composition in the development area during such time period an electrical field greater than the electrical breakdown value of the developer, thereby causing the developer composition to undergo electrical breakdown in the development of the electrostatic charge pattern.

5. An electrographic process wherein a support bearing an electrostatic charge pattern is developed, said process comprising:

providing a dry, electrographic developer composition comprising a triboelectric mixture of carrier particles and toner particles and having a low field resistivity of at least $10^5$ ohm-cm and a predetermined electrical breakdown value which is less than 25 volts/mm;

contacting the electrostatic charge pattern with the developer composition in a development area for a time period sufficient to desposit toner particles from the developer composition onto said electrostatic charge pattern thereby developing an image; and controlling the development process in the development area to establish across the developer composition in the development area during such time period an electrical field greater than the electrical breakdown value of the developer, thereby causing the developer composition to undergo electrical breakdown in the development of the electrostatic charge pattern.

6. An electrographic process wherein a support bearing an electrostatic charge pattern is developed, said process comprising:

providing a dry, electrographic developer composition comprising a triboelectric mixture of carrier particles and toner particles and having a predetermined electrical breakdown value; said carrier particles contacting the electrostatic charge pattern with the developer composition in a development area for a time period sufficient to deposit toner particles from the developer composition onto said electrostatic charge pattern thereby developing an image; and controlling the development process in the development area to establish across the developer composition in the development area during such time period an electrical field greater than the electrical breakdown value of the developer, thereby causing the developer composition to undergo electrical breakdown in the development of the electrostatic charge pattern;

wherein the controlling step includes imposing high frequency A.C. potential across the developer.

7. An electrographic process wherein a support bearing an electrostatic charge pattern is developed, said process comprising:

providing a dry, electrographic developer composition comprising a triboelectric mixture of carrier particles and toner particles and having a predetermined electrical breakdown value, said carrier particles comprising a core of ferromagnetic material;

contacting the electrostatic charge pattern in a development area with the developer composition in a magnetic brush development apparatus for a time period sufficient to deposit toner particles from the developer composition onto said electrostatic charge pattern thereby developing an image; and establishing across the developer composition in the development area during such time period an electrical field greater than the electrical breakdown value of the developer, thereby causing the developer composition to undergo electrical breakdown in the development of the electrostatic charge pattern.

8. An electrographic process wherein a support bearing an electrostatic charge pattern is developed, said process comprising:

providing a dry, electrographic developer composition comprising a triboelectric mixture of carrier particles and toner particles and having a low field resistivity of at least $10^5$ ohm-cm and a predetermined electrical breakdown value, said carrier particles comprising a core of ferromagnetic material;

contacting the electrostatic charge pattern in a development area with the developer composition in a magnetic brush development apparatus for a time period sufficient to deposit toner particles from the developer composition onto said electrostatic charge pattern thereby developing an image; and controlling the development process in the development area to establish across the developer composition in the development area during such time period an electrical field greater than the electrical breakdown value of the developer, thereby causing the developer composition to undergo electrical breakdown in the development of the electrostatic charge pattern.

9. An electrographic process wherein a support bearing an electrostatic charge pattern is developed, said process comprising:

providing a dry, electrographic developer composition comprising a triboelectric mixture of carrier particles and toner particles and having a predetermined electrical breakdown value which is less than 25 volts/mm, said carrier particles comprising a core of ferromagnetic material;

contacting the electrostatic charge pattern in a development area with the developer composition in a magnetic brush development apparatus for a time period sufficient to deposit toner particles from the developer composition onto said electrostatic charge pattern thereby developing an image; and controlling the development process in the development area to establish across the developer composition in the development area during such time period an electrical field greater than the electrical breakdown value of the developer, thereby causing the developer composition to undergo electrical breakdown in the development of the electrostatic charge pattern.

10. An electrographic process wherein a support bearing an electrostatic charge pattern is developed, said process comprising:

providing a dry, electrographic developer composition comprising a triboelectric mixture of carrier particles and toner particles and having a low field resistivity of at least $10^5$ ohm-cm and a predetermined electrical breakdown value which is less than 25 volts/mm, said carrier particles comprising a core of ferromagnetic material;

contacting the electrostatic charge pattern in a development area with the developer composition in a magnetic brush development apparatus for a time period sufficient to deposit toner particles from the developer composition onto said electrostatic charge pattern thereby developing an image; and controlling the development process in the development area to establish across the developer composition in the development area during such time period an electrical field greater than the electrical breakdown value of the developer, thereby causing the developer composition to undergo electrical breakdown in the development of the electrostatic charge pattern.

11. An electrographic process wherein a support bearing an electrostatic charge pattern is developed with a magnetic brush development apparatus using a dry, electrographic developer composition comprising a triboelectric mixture of carrier particles and toner particles and having a predetermined electrical breakdown value, said carrier particles comprising a core of ferromagnetic material, said process comprising:

contacting the electrostatic charge pattern with the developer composition in a development area for a time period sufficient to deposit toner particles from the developer composition onto said electrostatic charge pattern thereby developing an image; and establishing across the developer composition in the development area during such time period an electrical field greater than the electrical breakdown value of the developer, thereby causing the developer composition to undergo electrical breakdown in the development of the electrostatic charge pattern;

wherein the establishing step includes imposing high frequency A.C. potential across the developer.

12. An electrographic process wherein a support bearing an electrostatic charge pattern is developed with a magnetic brush development apparatus, said process comprising:

providing a dry, electrographic developer composition comprising a triboelectric mixture of carrier particles and toner particles and having a predetermined electrical breakdown value, said carrier particles comprising a core of ferromagnetic material having plated therein a thin, continuous layer of an electrically conducting metal having a resistance to aerial oxidation greater than that of iron and having coated therein an outermost layer of a resin;

contacting the electrostatic charge pattern with the developer composition in a development area for a time period sufficient to deposit marking particles onto the electrostatic charge pattern thereby developing an image; and controlling the development process in the development area to establish across the developer composition in the development area during such time period an electrical field greater than the electrical breakdown value of the developer, thereby causing the developer composition to undergo electrical breakdown in the development of the electrostatic charge pattern.

13. An electrographic process wherein a support bearing an electrostatic charge pattern is developed with a magnetic brush development apparatus, said process comprising:

providing a dry, electrographic developer composition comprising a triboelectric mixture of carrier particles and toner particles and having a predetermined electrical breakdown value which is less than 15 volts/mm, said carrier particles comprising a core of ferromagnetic material having plated thereon a thin, continuous layer of an electrically conducting metal having a resistance to aerial oxidation greater than that of iron and having coated thereon an outermost layer of a resin;

contacting the electrostatic charge pattern with the developer composition in a development area for a time period sufficient to deposit marking particles onto the electrostatic charge pattern thereby developing an image; and controlling the development process in the development area to establish across the developer composition in the development area during such time period an electrical field greater than the electrical breakdown value of the developer, thereby causing the developer composition to undergo electrical breakdown in the development of the electrostatic charge pattern.

* * * * *